US006488538B1

(12) United States Patent
Matsuba et al.

(10) Patent No.: US 6,488,538 B1
(45) Date of Patent: Dec. 3, 2002

(54) TUBE LAMP AND ITS MANUFACTURING METHOD

(75) Inventors: Tetsuo Matsuba, Neyagawa (JP); Yoshinori Kakuno, Katano (JP)

(73) Assignee: Matsushita Electric Industrial Co., Ltd. (JP)

( * ) Notice: Subject to any disclaimer, the term of this patent is extended or adjusted under 35 U.S.C. 154(b) by 52 days.

(21) Appl. No.: 09/693,989

(22) Filed: Oct. 23, 2000

(30) Foreign Application Priority Data

Nov. 2, 1999 (JP) ..... 11-311996

(51) Int. Cl.[7] ..... H01J 9/03
(52) U.S. Cl. ..... 439/615
(58) Field of Search ..... 439/226, 611, 439/612, 615, 620; 313/318.01, 318.03, 318.04, 318.09, 318.1, 318.12; 315/58

(56) References Cited

U.S. PATENT DOCUMENTS

| | | | | | |
|---|---|---|---|---|---|
| 4,982,032 | A | * | 5/1990 | Skoch et al. | 313/318 |
| 5,128,590 | A | * | 7/1992 | Holzer | 315/58 |
| 5,164,635 | A | * | 11/1992 | De Jong et al. | 315/58 |
| 5,289,079 | A | * | 2/1994 | Wittmann | 313/318 |
| 5,345,142 | A | * | 9/1994 | Chamberlain et al. | 315/58 |
| 5,381,070 | A | | 1/1995 | Tuttle et al. | 313/318 |
| 5,492,477 | A | * | 2/1996 | Moon | 439/57 |
| 5,538,443 | A | * | 7/1996 | Inoue et al. | 439/699.2 |
| 5,629,586 | A | * | 5/1997 | Yasuda et al. | 315/46 |
| 5,744,901 | A | * | 4/1998 | Friederichs et al. | 313/113 |
| 5,744,913 | A | * | 4/1998 | Martich et al. | 315/158 |
| 5,747,919 | A | * | 5/1998 | Gandhi et al. | 313/318.01 |
| 5,800,212 | A | * | 9/1998 | Hsu | 439/619 |
| 5,828,170 | A | * | 10/1998 | Nishio et al. | 313/493 |
| 6,011,347 | A | * | 1/2000 | Wittmann | 313/318.09 |

FOREIGN PATENT DOCUMENTS

| | | |
|---|---|---|
| EP | 0 179 251 | 4/1986 |
| EP | 0 480 503 | 4/1992 |
| EP | 0 664 556 | 7/1995 |
| EP | 0 698 902 | 2/1996 |
| GB | 2 136 201 | 12/1984 |
| JP | 09097589 | 4/1997 |
| JP | 10097839 | 4/1998 |

* cited by examiner

*Primary Examiner*—Brian Sircus
*Assistant Examiner*—Thanh-Tam Le
(74) *Attorney, Agent, or Firm*—Parkhurst & Wendel, L.L.P.

(57) ABSTRACT

The present invention provides a tube lamp and its manufacturing method which allow a lighting circuit and a shell to be easily and reliably connected together, which enable automation of a step of connecting the lighting circuit and the shell together, and which require low costs while achieving a high production efficiency. The tube lamp includes a case having a shell at an end thereof, and a lighting circuit housed in the case and having a printed circuit board with a circuit part mounted thereon, wherein the shell and the lighting circuit are connected together without leads.

8 Claims, 12 Drawing Sheets

TUBE LAMP AND ITS MANUFACTURING METHOD

FIELD OF THE INVENTION

The present invention relates to a tube lamp and its manufacturing method.

BACKGROUND OF THE INVENTION

A conventional tube lamp, for example, a bulb type fluorescent lamp comprises an enclosure comprising a globe 1 and a case 37, a fluorescent tube 4, a lighting circuit 38 for lighting the fluorescent tube 4, the fluorescent lamp and the lighting circuit both being housed in the enclosure, as shown in FIG. 16.

The case 37 has a base 41 screwed on one end thereof and having an eyelet 39 and a shell 40.

The lighting circuit 38 has two leads 42 and 43 for supplying power. One 42 of the leads is led out from a through-hole formed in the eyelet 39 and is electrically connected to an outer surface of the eyelet 39 by means of soldering.

The other lead 43 is led to an exterior of the case 37 and electrically connected to an outer surface of the shell 40 by means of soldering.

In such a conventional tube lamp, however, the lighting circuit 38 and the base 41 are connected via the leads 42 and 43, that is, the conventional tube lamp requires the following operations: The one 42 of the leads is straightened and passed through the through-hole 44 in the eyelet 39, the other lead 43 is bent and led to the exterior of the case 37, and the leads 42 and 43 are then brought into contact with the outer surface of the shell and their unwanted portions are cut off for the soldering. These operations must be manual, thereby reducing productivity and increasing costs.

SUMMARY OF THE INVENTION

The present invention is provided to solve these problems, and it is an object thereof to provide a tube lamp and its manufacturing method which allow a lighting circuit and a shell to be easily and reliably connected together, which enable automation of a step of connecting the lighting circuit and the shell together, and which require low costs while achieving a high production efficiency.

A tube lamp according to the present invention comprises a case including a base portion having a shell at an end thereof, and a lighting circuit housed in the case and comprising a printed circuit board with a circuit part mounted thereon, the shell and the lighting circuit being connected together without leads.

Additionally, a tube lamp manufacturing method according to the present invention manufactures a tube lamp comprising a case including a base portion having a shell at an end thereof, and a lighting circuit housed in the case and comprising a printed circuit board with a circuit part and terminals mounted thereon, the shell and the terminals being connected together, the method comprising connecting the terminals to the shell at the same time when the lighting circuit is housed in the case.

The tube lamp and its manufacturing method eliminate the needs for leads and soldering thereof to enable the shell and the lighting circuit to be easily and reliably connected together, enable automation of a step of connecting the lighting circuit and the shell together instead of depending on manual operations, improve production efficiency due to the omission of the soldering step, and reduces costs because of a reduction in maintenance costs for facilities required for the soldering step and in material costs for leads, solders, and the like. The omission of solders also contributes to environment protection.

DESCRIPTION OF THE EMBODIMENTS

The embodiments of the present invention will be described below with reference to the drawings.

Figure 1:
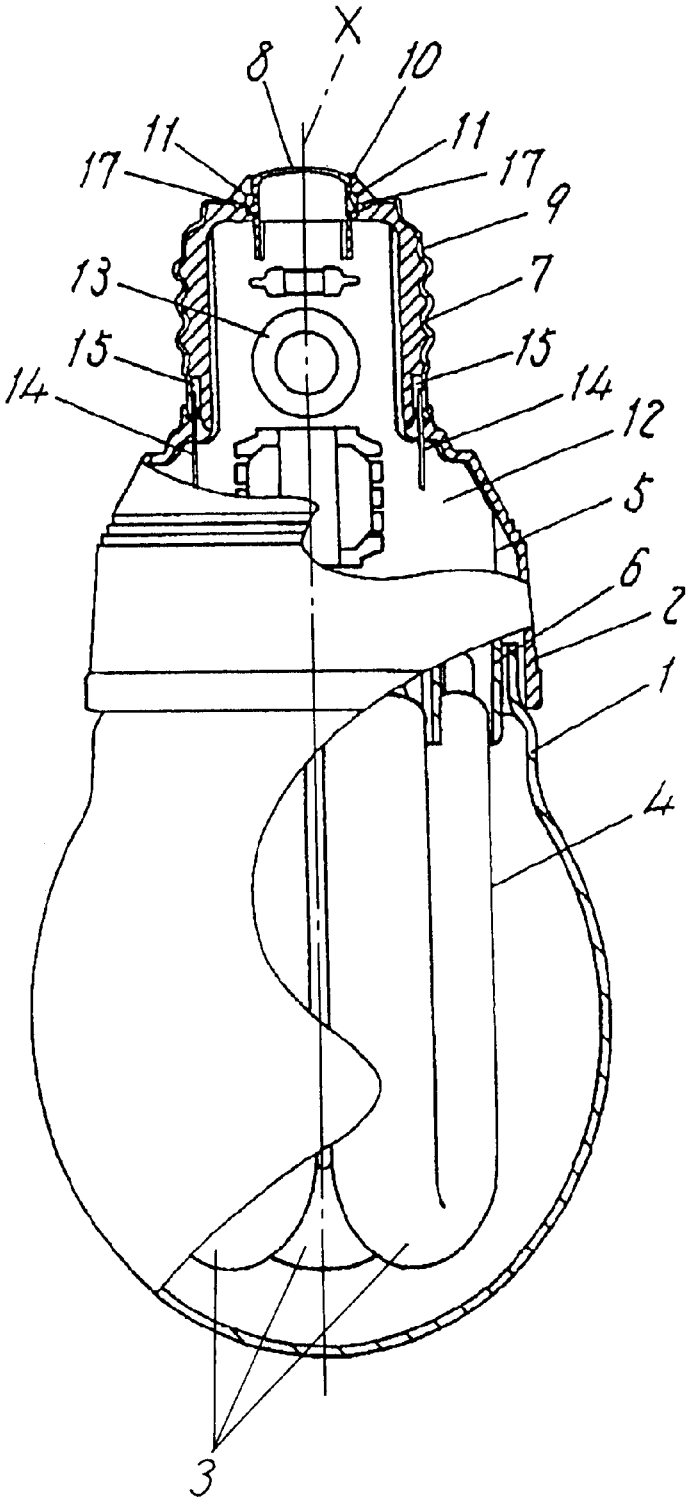
FIG. 1 is a partly cutaway front view of a bulb type fluorescent lamp according to a first embodiment of the present invention.

A bulb type fluorescent lamp of rated power 13 W according to a first embodiment of the present invention has a length of 120 mm and a maximum outer diameter of 60 mm, and comprises an enclosure formed of a transmissive globe 1 and a resin case 2, a fluorescent tube 4 in which three substantially U-shaped tubes 3 each having an outer diameter of 11 mm are bridged together to form a single discharge path, a lighting circuit 5 for lighting the fluorescent lamp 4, and a holder 6 for holding one end of the fluorescent tube 4 and also holding the lighting circuit 5 opposite to the fluorescent tube 4, as shown in FIG. 1.

The case 2 has a base portion 7 formed at one end thereof and which is inserted into a socket of a luminaire. The base portion 7 has an eyelet 8 and a shell 9 both coming in electric contact with the socket. The base portion 7 also has an eyelet receiving section 10 at a tip portion thereof in which the eyelet 8 is fitted.

The eyelet receiving section 10 has four locked portions 11 (only two are shown in FIG. 1) in an inner surface thereof in which a locking portion 17 of the eyelet 8, described later, is locked.

The fluorescent tube 4 has electrodes (not shown) each located at a corresponding one of opposite ends thereof. The fluorescent tube 4 also has predetermined amounts of mercury and rare gas sealed inside.

The lighting circuit 5 comprises a T-shaped printed circuit board 12 with a circuit part 13 mounted thereon. The printed circuit board 12 is located inside the case 2 parallel with a central axis X thereof with a leg part of the character T up.

Figure 2:
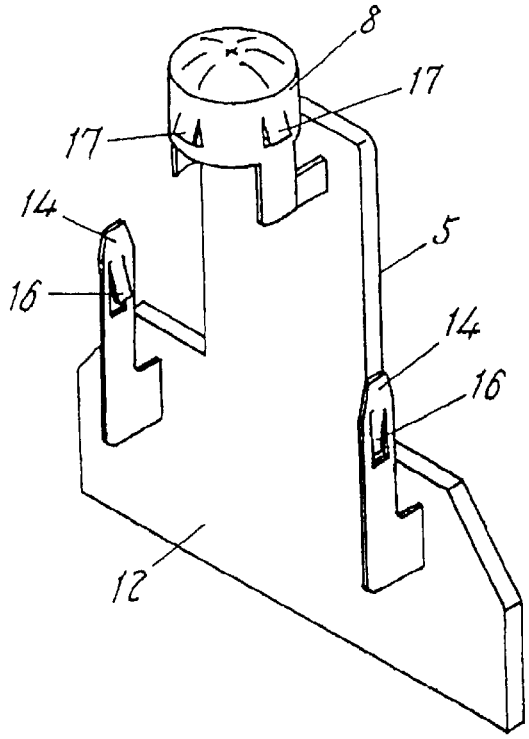
FIG. 2 is a perspective view of a lighting circuit used in this bulb type fluorescent lamp, showing its integral part in an enlarged view.

The printed circuit board 12 also has two terminals 14 and an eyelet 8 mounted thereon as also shown in FIG. 2.

In FIG. 2, the circuit part on the printed circuit board 12 is omitted.

The terminal 14 comprises an L-shaped copper alloy plate of thickness 0.1 to 0.5 mm.

Figure 3:
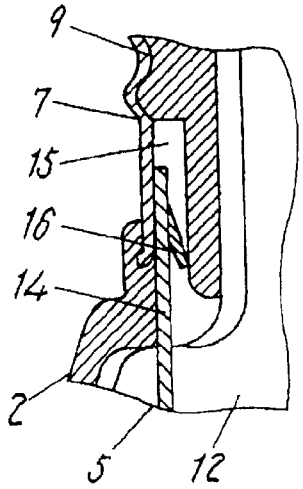
FIG. 3 is a sectional view of this bulb type fluorescent lamp, showing its integral part in an enlarged view.

The terminal 14 has its end inserted into a gap 15 formed between the shell 9 and a depression formed by cutting a resin portion off from the base portion 7 so that this end is in electric contact with an inner surface of the shell 9 within the gap 15, as shown in FIG. 3. The term "electric contact" refers to a means for "electric connection".

For a reliable electric contact, the shell 9 and the terminals 14 are preferably connected together by means of laser welding or a conductive adhesive or paste.

The terminals 14 each have a cut and raised portion 16 formed by cutting a substantially U-shaped portion out therefrom as shown in FIG. 2. Further, the cut and raised portion 16 is bent inward and acts as a plate spring. As shown in FIG. 3, by bringing the cut and raised portion 16, having a spring property, into pressure contact with the inner surface of the case 2, the terminal 14 can be pushed toward the shell 9 so as to reliably come in electric contact therewith.

It may be contemplated that the terminal 14 entirely has the spring property so as to be pushed toward the shell 9 so as to reliably come in electric contact therewith independently of the spring property of the cut and raised portion 16. In this case, however, a connection between the printed circuit board 12 and the terminal 14 is subjected to a load and fatigued, so that the terminals 14 may slip out from the printed circuit board 12.

On the other hand, when the terminals 14 each have the cut and raised portion 16 formed at its end, the above described load is exerted on the cut and raised portion 16, which is part of the terminal 14. Consequently, the load on the connection between the printed circuit board 12 and the terminal 14 decreases to restrain the connection from being fatigued, thereby preventing the terminals 14 from slipping out from the printed circuit board 12.

Although FIG. 3 shows one of the terminals 14, the other terminal 14 has the same configuration.

The eyelet 8 is obtained by pressing a plate of thickness 0.3 to 1 mm into a recessed form as shown in FIG. 2.

In addition, a head portion of the eyelet 8, that is, a portion of the eyelet 8 which is exposed from the case 2 has such a projecting shape that it is gently expanded. This shape enables the eyelet 8 and the socket of the luminaire (not shown) to be reliably electrically connected together.

The eyelet 8 has four locking portions 17 (only two are shown in FIG. 2) formed by cutting and raising part of a side surface of the eyelet into a U shape. The locking sections 17 are each slightly bent outward relative to the eyelet 8. The eyelet 8 is fitted in the eyelet receiving section 10 in such a manner that the locking portions 17 are locked in corresponding locked portions 11 of the eyelet receiving section 10. Consequently, when the base portion 7 is mounted in the socket of the luminaire (not shown), the eyelet 8 is prevented from slipping out from the eyelet receiving section 10 when pushed into the case 2 with the lighting circuit 5, thereby precluding an inappropriate contact between the eyelet 8 and the socket (not shown).

Next, a method for manufacturing such a bulb type fluorescent lamp will be explained.

First, the fluorescent tube 4 is attached to the holder 6 in a conventional manner using an adhesive (not shown).

The lighting circuit 5 with the eyelet 8, the circuit part 13, and the terminals 14 mounted thereon is mounted in the holder 6 with the fluorescent tube 4 attached thereto in such a manner that the lighting circuit 5 extends perpendicularly to the holder 6.

The lighting circuit 5 is subsequently housed in the case 2. At this point, the eyelet 8 is internally inserted and fitted in the eyelet receiving section 10, and the ends of the terminals 14, that is, the cut and raised portions 16 are inserted into the gap 15 formed between the depression and the shell 9 so that the shell 9 and the terminals 14 are electrically connected together.

When the eyelet 8 is fitted in the eyelet receiving section 10, the locking portions 17 of the eyelet 8 are bent inward of the eyelet 8 and then outward thereof at the locked portions 11 due to their elasticity, that is, the locking portions 17 finally return to their original states and are thus locked in the locked portions 11.

Finally, the globe 1 is fixed to the case 2 and the holder 6 using an adhesive (not shown). The bulb type fluorescent lamp is manufactured in this manner.

This embodiment eliminates the needs for leads and soldering thereof to enable the lighting circuit 5 and the shell 9 to be easily and reliably connected together and enable automation of a step of connecting the lighting circuit 5 and the shell 9 together instead of depending on manual operations. Production efficiency can also be improved due to the omission of the soldering step. Costs can also be reduced because of a reduction in maintenance costs for facilities required for the soldering step and in material costs for leads, solders, and the like. The omission of solders also contributes to environment protection.

In the first embodiment, the cut and raised portions 16 are bent inward, but similar effects are obtained if the cut and raised portions 16 are bent outward and are in pressure contact with the inner surface of the shell 9.

Figure 4:
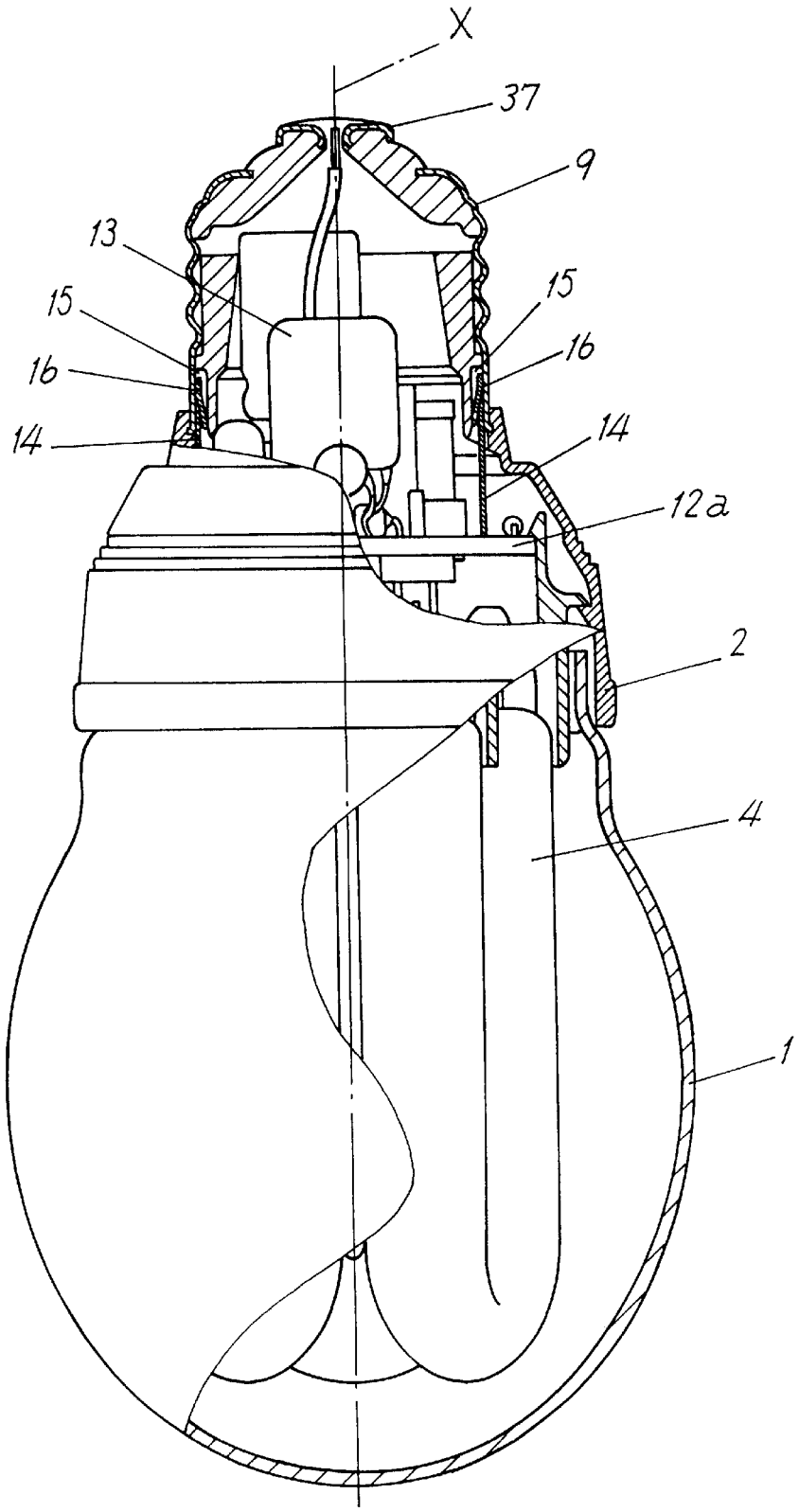
FIG. 4 is a partly cutaway front view showing a variation of this bulb type fluorescent lamp.

Additionally, in the first embodiment, the printed circuit board 12 is located inside the case 2 parallel with the central axis X thereof with the leg part of the character T up, but similar effects are obtained if, for example, a substantially disc-shaped printed circuit board 12*a* is located inside the case perpendicularly to the central axis X thereof as shown in FIG. 4. In the example shown in FIG. 4, however, an eyelet 39 is shaped like a disc as in the prior art.

Figure 5:
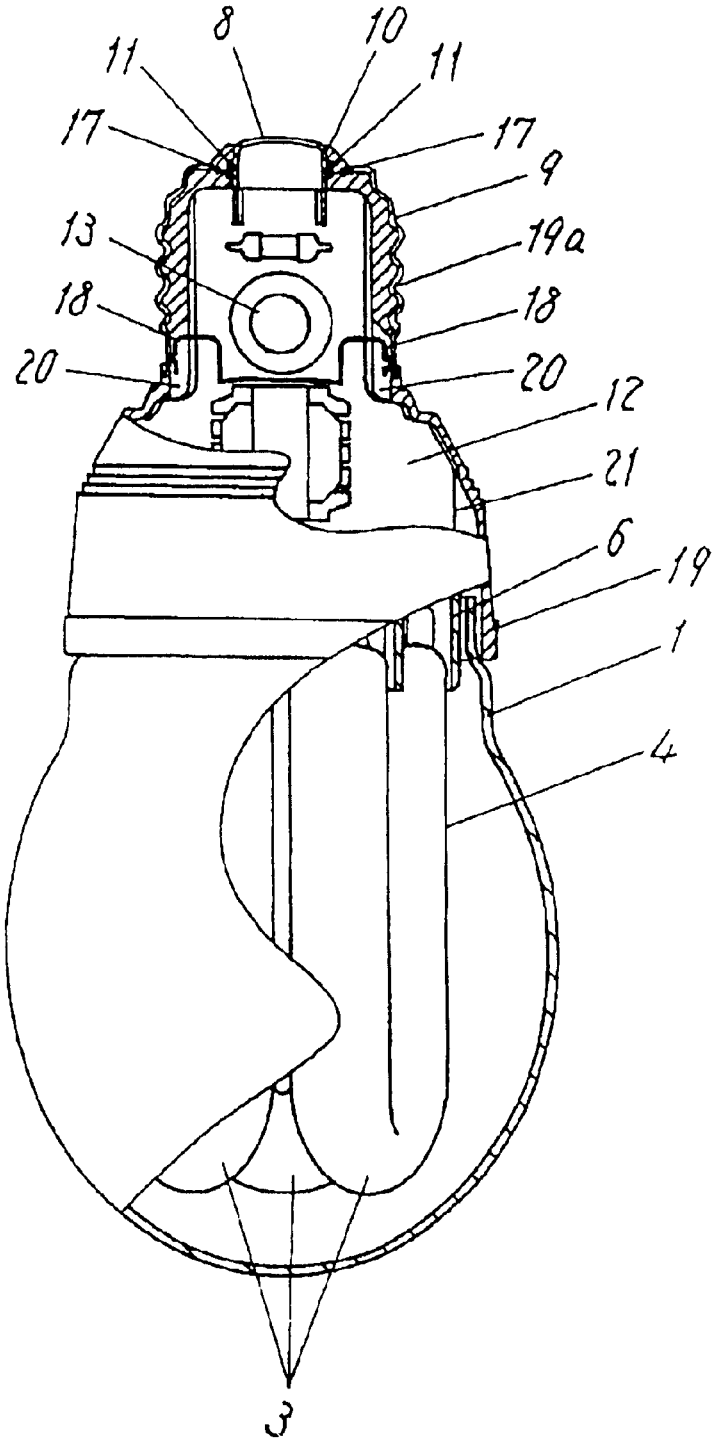
FIG. 5 is a partly cutaway front view of a bulb type fluorescent lamp according to a second embodiment of the present invention.

Next, a bulb type fluorescent lamp of rated power 13 W according to a second embodiment of the present invention has the same configuration as the bulb type fluorescent lamp of rated power 13 W according to the first embodiment of the present invention except that the printed circuit board 12 has two terminals 18 mounted thereon and each comprising a substantially U-shaped copper alloy plate of thickness 0.1 to 0.5 mm, the terminals 18 being in electric contact with the inner surface of the shell 9 through corresponding notches 20 formed in the case 19 as shown in FIG. 5.

In FIG. 5, reference numeral 19*a* denotes a base portion of the case 19 and reference numeral 21 denotes a lighting circuit.

The end of each of the terminals 18 has a projecting shape in a portion thereof that is in substantially electric contact with the shell 9. This shape ensures an electric contact between the shell 9 and the terminal 18.

In addition, the end of each of the terminals 18 has the spring property. This enables the terminal 18 to come in pressure contact with the inner surface of the shell 18 to ensure an electric contact between the shell 9 and the terminal 18.

Figure 6:
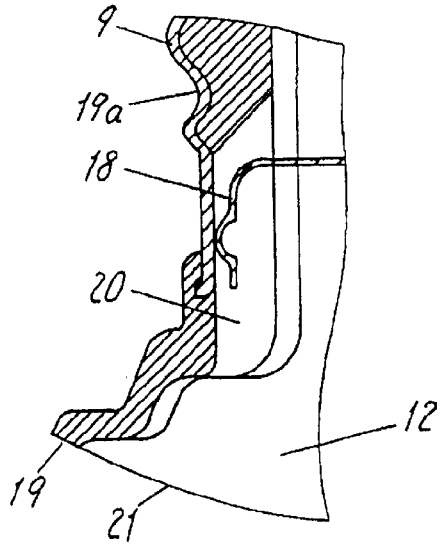
FIG. 6 is a sectional view of this bulb type fluorescent lamp, showing its integral part in an enlarged view.

In FIG. 6, one of the terminals 18 is shown, but the other terminal 18 has the same configuration.

Additionally, the end of each of the terminals 18 is divided into two, which are each electrically contacted with the shell (not shown). This configuration can increase the number of electric contacts between the shell 9 and the terminal 18 to further reliably contact the shell 9 and the terminal 18 with each other, thereby allowing the shell 9 and the terminal 18 to be more reliably connected together.

A plate-shaped connection 18*a* is provided between the terminals 18 to reduce a load on the connection between the printed circuit board 12 and the terminal 18.

Figure 7:
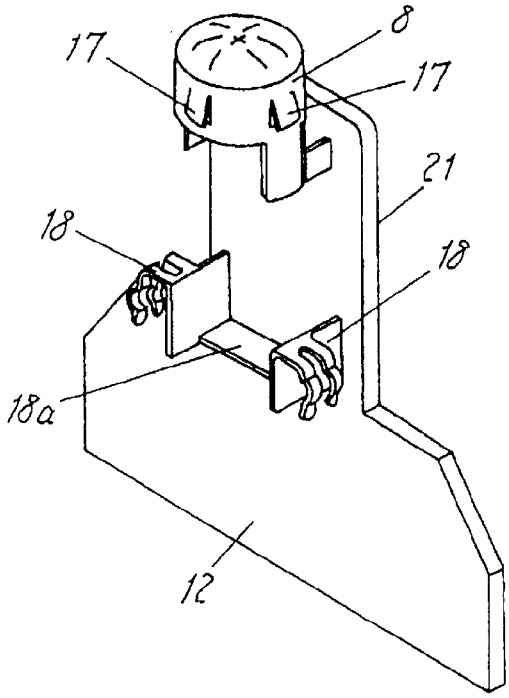
FIG. 7 is a perspective view of a lighting circuit used in this bulb type fluorescent lamp, showing its integral part in an enlarged view.

In FIG. 7, the circuit part on the printed circuit board is omitted.

The notches 20 are each formed by cutting out part of a resin portion at an end of the base portion 19*a* opposed to the eyelet 8.

Like the bulb type fluorescent lamp of rated power 13 W according to the first embodiment, this embodiment eliminates the needs for leads and soldering thereof to enable the shell 9 and the lighting circuit 21 to be easily and reliably connected together and enable automation of a step of connecting the shell 9 and the lighting circuit 21 together instead of depending on manual operations. Production efficiency can also be improved due to the omission of the soldering step. Costs can also be reduced because of a reduction in maintenance costs for facilities required for the soldering step and in material costs for leads, solders, and the like. The omission of solders also contributes to environment protection.

Figure 8:
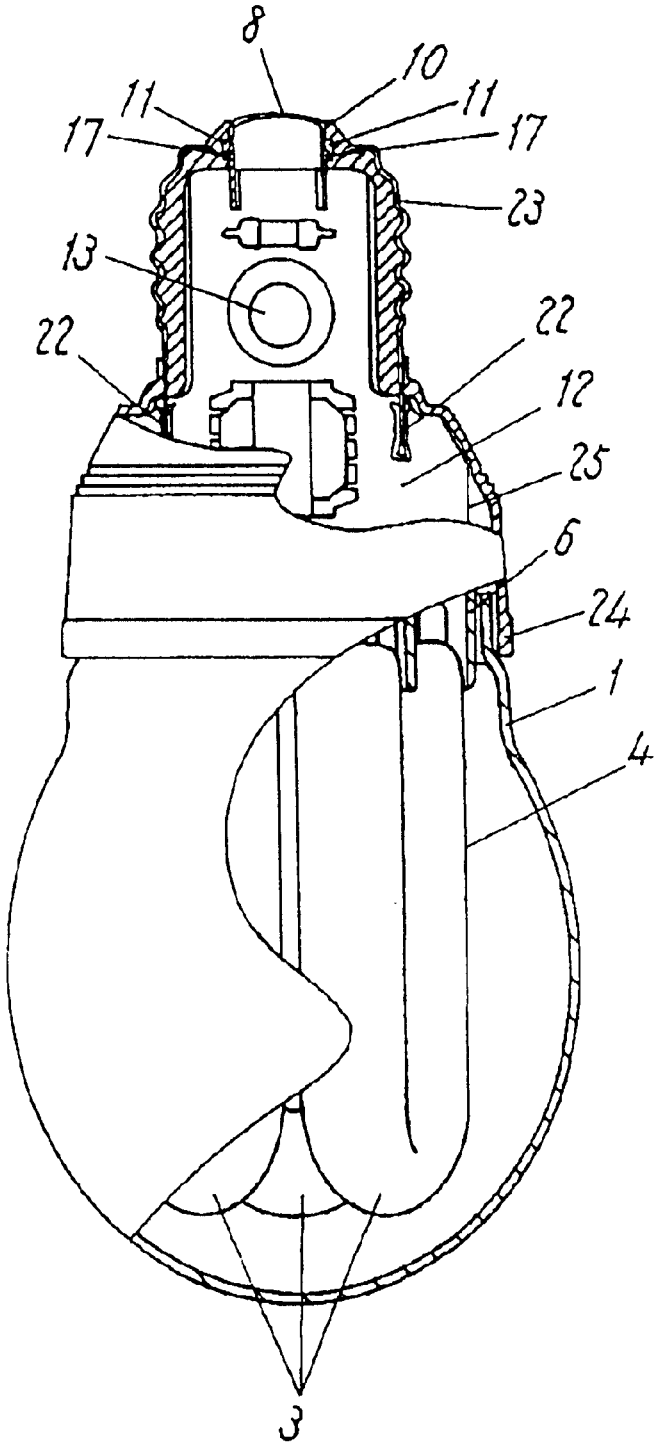
FIG. 8 is a partly cutaway front view of a bulb type fluorescent lamp according to a third embodiment of the present invention.
Figure 9:
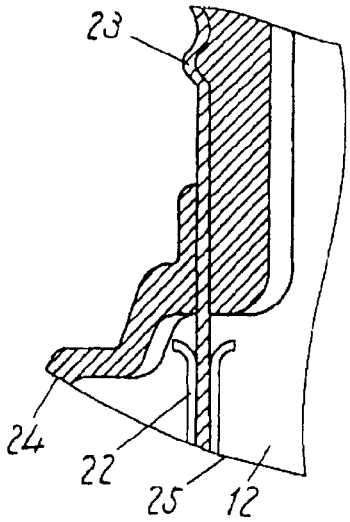
FIG. 9 is a sectional view of this bulb type fluorescent lamp, showing its integral part in an enlarged view.

Next, a bulb type fluorescent lamp of rated power 13 W according to a third embodiment of the present invention has the same configuration as the bulb type fluorescent lamp of rated power 13 W according to the first embodiment of the present invention except that two sandwiching terminals 22 are mounted on the printed circuit board 12 and that part of the shell 23 penetrates a case 24 to extend therethrough in a fashion being sandwiched between the sandwiching terminals 22, as shown in FIGS. 8 and 9.

In FIGS. 8 and 9, reference numeral 25 denotes a lighting circuit. In FIG. 9, one of the terminals 22 is shown, but the other terminal 22 has the same configuration.

Figure 10:
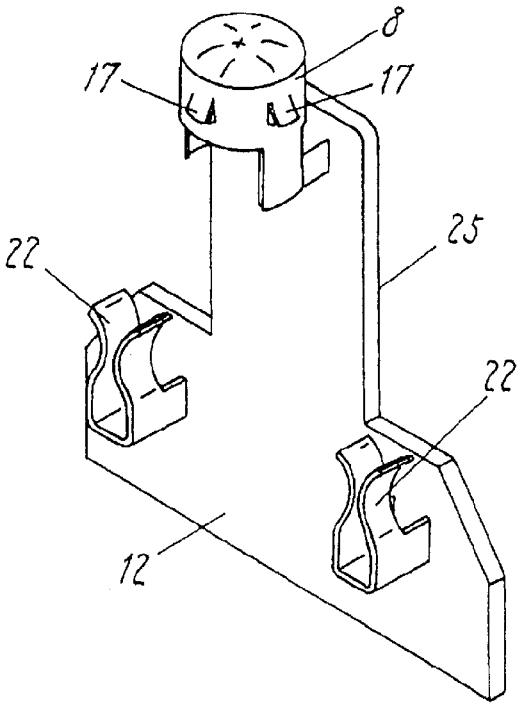
FIG. 10 is a perspective view of a lighting circuit used in this bulb type fluorescent lamp, showing its integral part in an enlarged view.

FIG. 10 shows the lighting circuit 25, comprising the eyelet 8 and the two sandwiching terminals 22 mounted on the printed circuit board 12. However, the circuit part on the printed circuit board 12 is omitted.

Like the bulb type fluorescent lamps of rated power 13 W according to the first and second embodiments, this embodiment eliminates the needs for leads and soldering thereof to enable the shell 24 and the lighting circuit 25 to be easily and reliably connected together and enable automation of a step of connecting the shell 24 and the lighting circuit 25 together instead of depending on manual operations. Production efficiency can also be improved due to the omission of the soldering step. Costs can also be reduced because of a reduction in maintenance costs for facilities required for the soldering step and in material costs for leads, solders, and the like. The omission of solders also contributes to environment protection.

Next, a bulb type fluorescent lamp of rated power 13 W according to a fifth embodiment has the same configuration as the bulb type fluorescent lamp of rated power 13 W according to the first embodiment of the present invention except that two terminals 26 with bent ends are mounted at the eyelet 8 side end on the printed circuit board 12 and extend through corresponding through-holes 28 formed in the case 27 before coming in electric contact with the inner surface of the shell 9.

Figure 11:
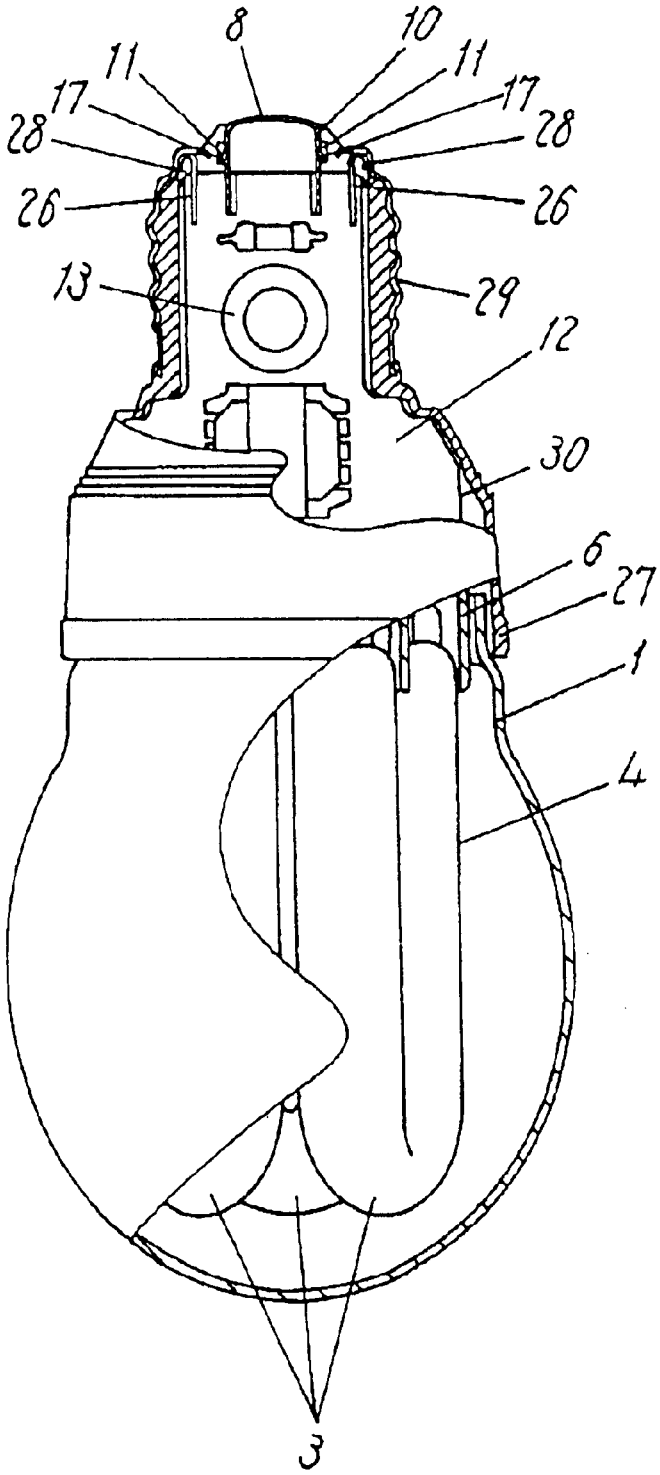
FIG. 11 is a partly cutaway front view of a bulb type fluorescent lamp according to a fourth embodiment of the present invention.
Figure 12:
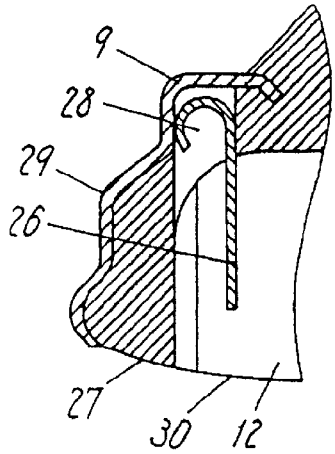
FIG. 12 is a sectional view of this bulb type fluorescent lamp, showing its integral part in an enlarged view.

In FIGS. 11 and 12, reference numeral 29 denotes a base portion of a case 27, and in FIG. 12, reference numeral 30 denotes a lighting circuit.

The end of each of the terminals 26 is pressure contact with the inner surface of the shell 9 and with a resin portion of the base portion 29 due to the spring property of this end. This ensures that the shell 9 and the terminal 26 are electrically contacted together to reduce the load on the connection between the printed circuit board 12 and the terminal 26.

The through-holes 28 are each formed by cutting out part of a resin portion at the eyelet 8 side end.

Figure 13:
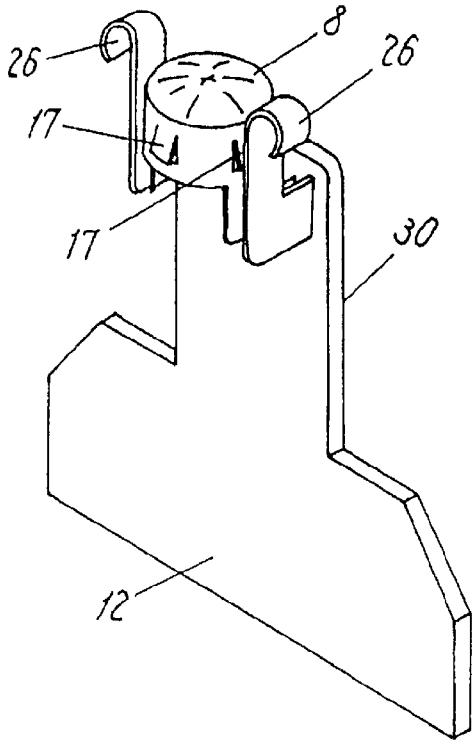
FIG. 13 is a perspective view of a lighting circuit used in this bulb type fluorescent lamp, showing its integral part in an enlarged view.

FIG. 13 shows the lighting circuit 30 comprising the eyelet 8 and the two terminals 26 mounted on the printed circuit board 12. In FIG. 13, however, the circuit part on the printed circuit board 12 is omitted.

Like the bulb type fluorescent lamps of rated power 13 W according to the above described embodiments, this embodiment eliminates the needs for leads and soldering thereof to enable the shell 9 and the lighting circuit 30 to be easily and reliably connected together and enable automation of a step of connecting the shell 9 and the lighting circuit 30 together instead of depending on manual operations. Production efficiency can also be improved due to the omission of the soldering step. Costs can also be reduced because of a reduction in maintenance costs for facilities required for the soldering step and in material costs for leads, solders, and the like. The omission of solders also contributes to environment protection.

In addition, the bent end of each of the terminals 26 can increase the contact area between the shell 9 and the terminal 26, thereby ensuring the electric contact between the shell 9 and the terminal 26.

Furthermore, although not shown, the end of each of the terminals 26 can be divided into two similarly to the end 18 shown in FIG. 6, thereby ensuring the electric contact between the shell 9 and the terminal 26.

Figure 14:
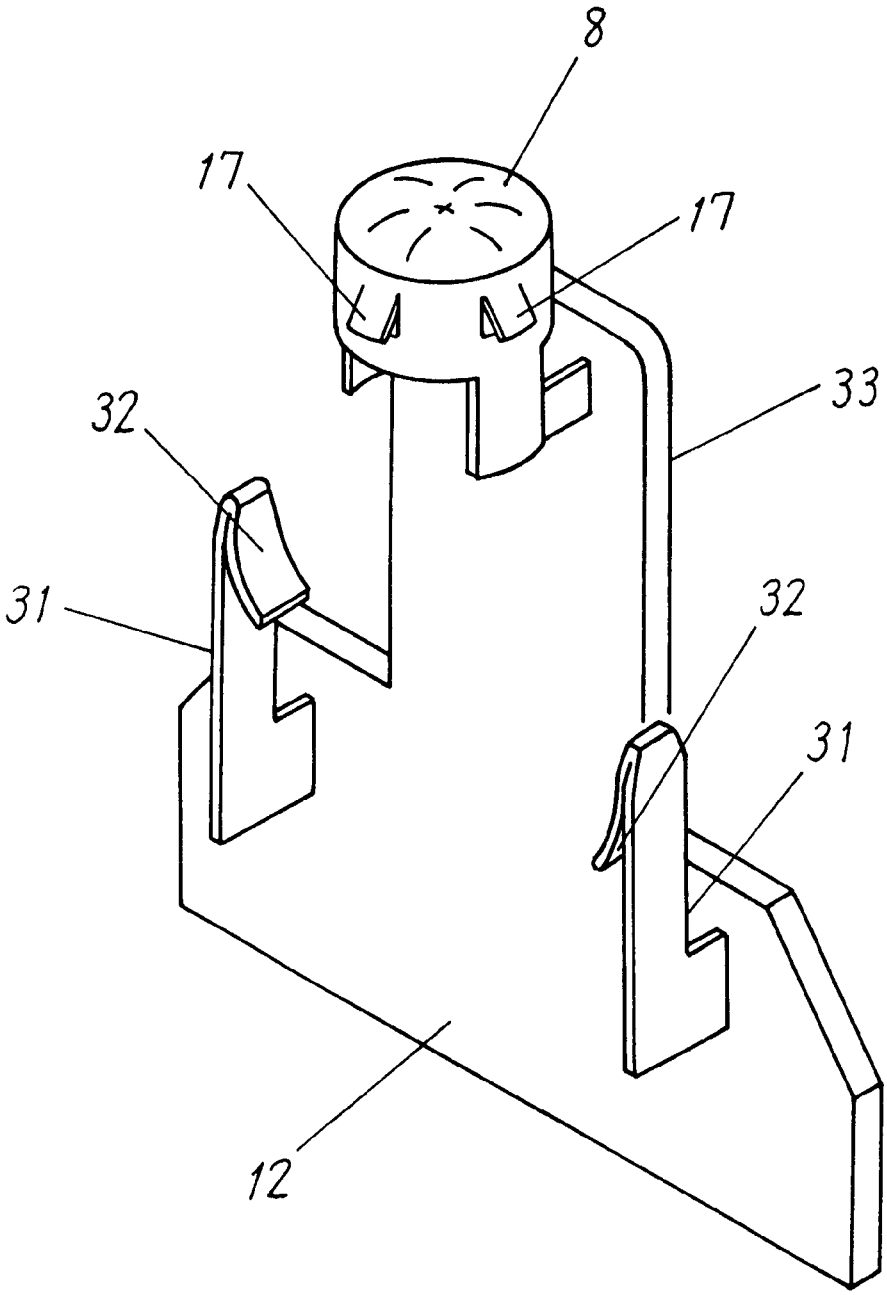
FIG. 14 is a perspective view of a lighting circuit used in a bulb type fluorescent lamp according to a fifth embodiment of the present invention, showing its integral part in an enlarged view.

Next, a bulb type fluorescent lamp of rated power 13 W according to a fifth embodiment has the same configuration as the bulb type fluorescent lamp of rated power 13 W according to the first embodiment of the present invention except that terminals 31 each have an inward folded portion 32 formed at a tip portion thereof instead of the cut and raised portion 16, as shown in FIG. 14.

In FIG. 14, reference numeral 33 denotes a lighting circuit and the circuit part on the printed circuit board 12 is omitted.

Although not shown, the folded portions 32 are each inserted into the gap 15 formed between the case 2 and the shell 9 as in FIG. 3, so as to come in pressure contact with the inner surface of the case 2 for electric contact. Additionally, due to its spring property, the folded portion 32 ensures the electric contact between the shell 9 and the terminal 31 while reducing the load on the connection between the printed circuit board 5 and the terminal 31.

The folded portion 32 may be folded outward so as to come in pressure contact with the inner surface of the case 2 instead of the shell 9 for electric contact.

Like the bulb type fluorescent lamps of rated power 13 W according to the above described embodiments, this embodiment eliminates the needs for leads and soldering thereof to enable the shell 9 and the lighting circuit 33 to be easily and reliably connected together and enable automation of a step of connecting the shell 9 and the lighting circuit 33 together instead of depending on manual operations. Production efficiency can also be improved due to the omission of the soldering step. Costs can also be reduced because of a reduction in maintenance costs for facilities required for the soldering step and in material costs for leads, solders, and the like. The omission of solders also contributes to environment protection.

Figure 15:
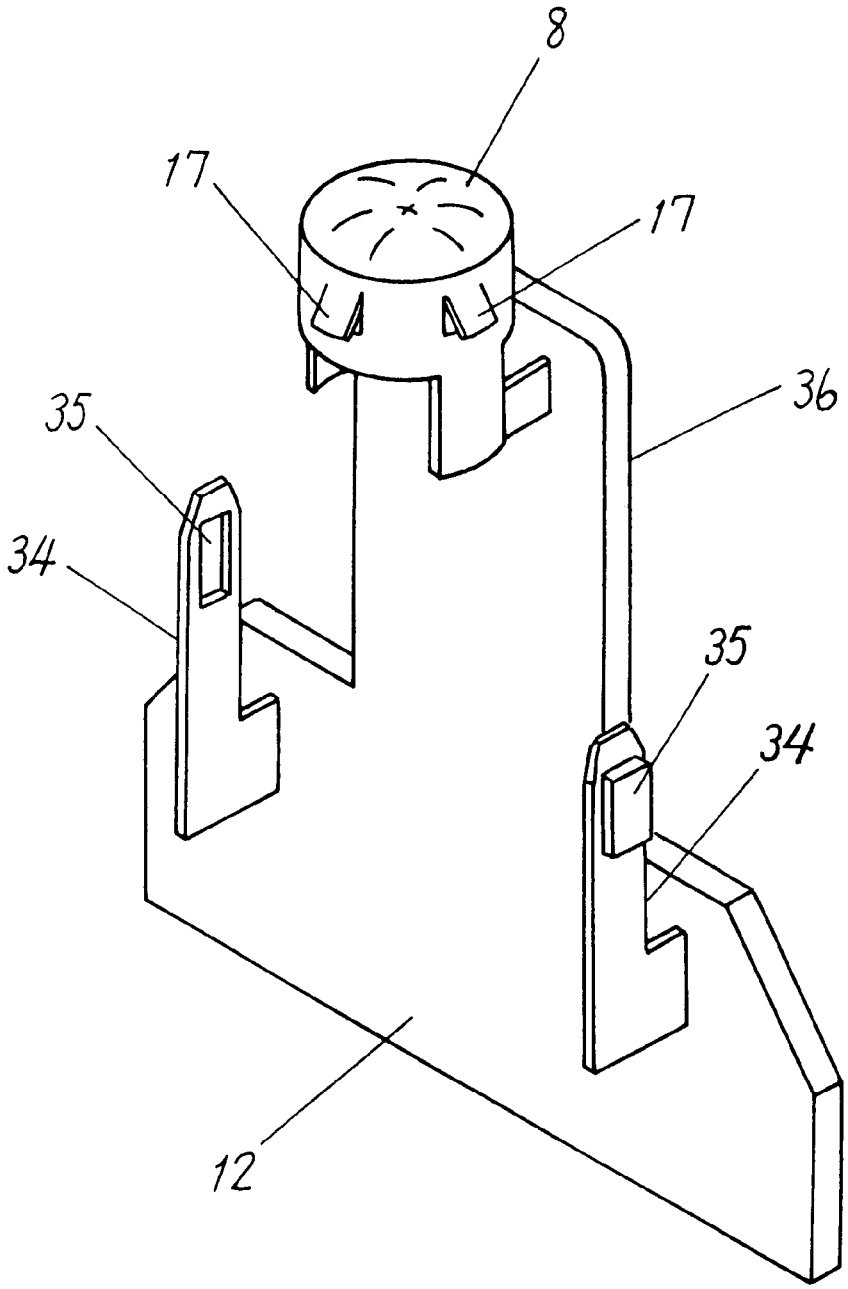
FIG. 15 is a perspective view of a lighting circuit used in a bulb type fluorescent lamp according to a sixth embodiment of the present invention, showing its integral part in an enlarged view.
Figure 16:
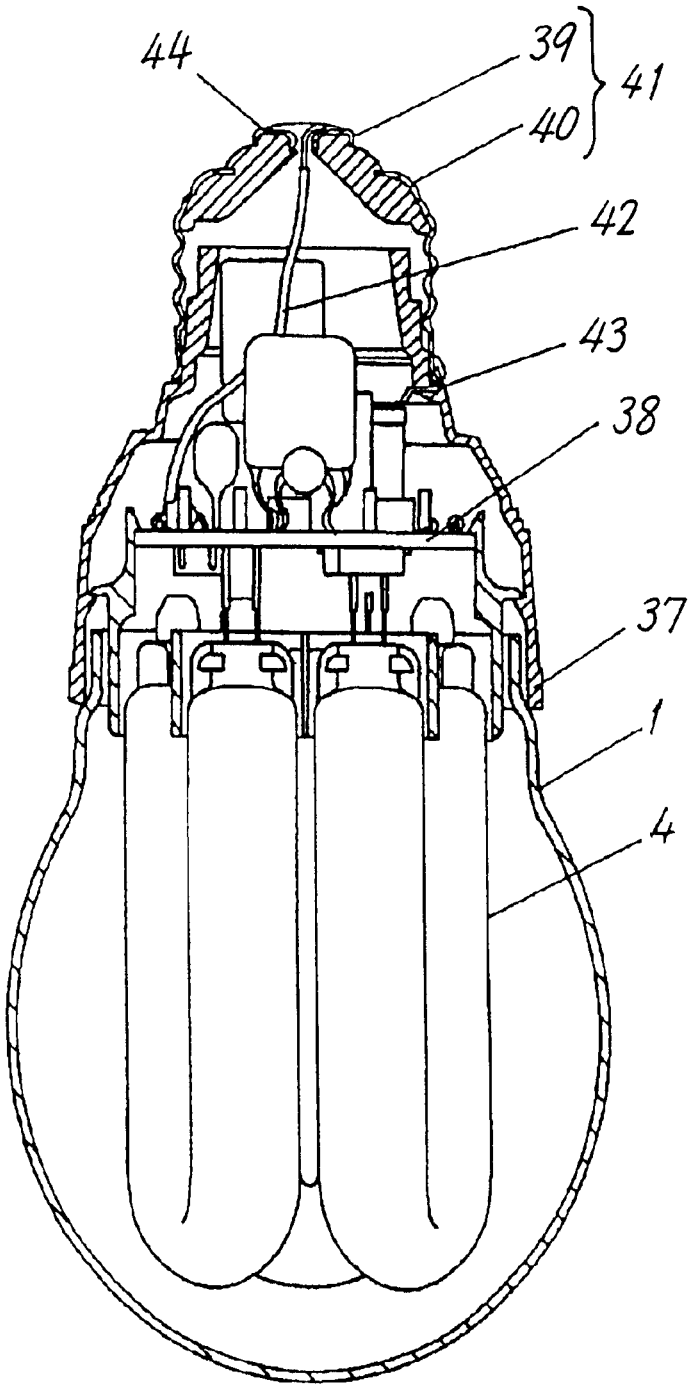
FIG.16 PRIOR ART
FIG. 16 is front sectional view of a conventional bulb type fluorescent lamp.

Next, a bulb type fluorescent lamp of rated power 13 W according to a sixth embodiment has the same configuration as the bulb type fluorescent lamp of rated power 13 W according to the first embodiment of the present invention except that terminals 34 each have an expanded portion 35 formed at an end thereof which has a projecting cross section and extends outward about 0.5 mm, as shown in FIG. 15.

In FIG. 15, reference numeral 36 denotes a lighting circuit and the circuit part on the printed circuit board 12 is omitted.

Although not shown, the expanded portions 35 are each inserted into the gap 15 formed between the case 2 and the shell 9 as in FIG. 3, so as to come in pressure contact with the inner surface of the shell 9 for electric contact.

The expanded portion 35 may be expanded inward so as to come in pressure contact with the inner surface of the case 2 instead of the shell 9 for electric contact.

Like the bulb type fluorescent lamps of rated power 13 W according to the above described embodiments, this embodiment eliminates the needs for leads and soldering thereof to enable the shell 9 and the lighting circuit 36 to be easily and reliably connected together and enable automation of a step of connecting the shell 9 and the lighting circuit 36 together instead of depending on manual operations. Production efficiency can also be improved due to the omission of the soldering step. Costs can also be reduced because of a reduction in maintenance costs for facilities required for the soldering step and in material costs for leads, solders, and the like. The omission of solders also contributes to environment protection.

In the above embodiments, the two terminals 14, 18, 22, 26, 31, or 34 are mounted on the printed circuit board 12. If at least one of the terminals 14, 18, 22, 26, 31, or 34 is mounted on the printed circuit boar 12, it can be reliably electrically connected with the shell 9 or 23. To improve the reliability, two or more of these terminals are preferably mounted on the printed circuit board 12.

Alternatively, in the second to sixth embodiments, similar effects are obtained if the printed circuit board 12*a* is located perpendicularly to the central axis of the case 19, 24, or 27 as in the first embodiment shown in FIG. 4.

Furthermore, the above embodiments have been described in conjunction with the bulb-type fluorescent lamp. The present invention, however, is not limited to this but is applicable to general incandescent lamps, reflector type lamps, high-voltage discharge lamps, or the like.

What is claimed is:

1. A tubular bulb comprising:

a case including a base portion at an end of the case, the base portion including a shell, and a lighting circuit housed in said case, said circuit comprising a printed circuit board with a circuit part and terminals mounted on the circuit board, said terminals for sliding and electric engagement with said shell, wherein said shell and said lighting circuit are connected together without leads.

2. The tubular bulb according to claim 1, wherein an end of each of said terminals is located in a gap between said case and said shell.

3. The tubular bulb according to claim 2, wherein each of said terminals has a cut and raised portion at an and thereof, the cut and raised portion in pressure contact with said case or said shell.

4. The tubular bulb according to claim 2, wherein said terminal has a folded portion at a tip portion thereof, said folded portion being in pressure contact with said case or said shell.

5. The tubular bulb according to claim 2, wherein said terminal has an expanded portion with a projecting cross section at an end thereof, said expanded portion being in pressure contact with said case or said shell.

6. The tubular bulb according to claim 1, wherein an end of said terminal is in locking engagement with said shell through a notch or a through-hole in said case.

7. The tubular bulb according to claim 1, wherein said terminals each comprise a sandwiching terminal, and said shell partly extends into the case and is at least partly seated in said sandwiching terminals.

8. A method for manufacturing a tubular bulb comprising:

providing a case having a base portion at an end of the case, the base portion including a shell, a lighting circuit housed in said case, the lighting circuit comprising a printed circuit board with a circuit part and terminals mounted on the circuit board, said shell and said lighting circuit being electrically connected together, and sliding simultaneously said terminals into electric engagement with said shell, thereby mounting said lighting circuit in said case.

* * * * *